US007574768B2

(12) United States Patent
Morris et al.

(10) Patent No.: US 7,574,768 B2
(45) Date of Patent: Aug. 18, 2009

(54) QUICK-RELEASE HANDLE AND INTERCHANGEABLE CLEANING SYSTEM

(75) Inventors: Cameron Ray Morris, Cumming, GA (US); Stephanie Ann Rossignol, Cumming, GA (US); George Nukuto, Neenah, WI (US); Denis R. Grimard, Appleton, WI (US); Carl G. Rippl, Appleton, WI (US); MeeWha Lee, Appleton, WI (US); Paul Woon, Alpharetta, GA (US); Russell J. Kroll, Atlanta, GA (US); Mark Londborg, Atlanta, GA (US); Robert Henshaw, Newnan, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 11/458,107

(22) Filed: Jul. 18, 2006

(65) Prior Publication Data

US 2008/0016636 A1 Jan. 24, 2008

(51) Int. Cl.
*B25G 3/24* (2006.01)

(52) U.S. Cl. ..... 15/145; 15/143.1; 15/176.6; 16/422; 403/322.2; 403/322.3

(58) Field of Classification Search ..... 15/145, 15/210.1, 229.2, 104, 118, 143.1, 176.1, 15/176.6; 16/422, 426; 403/322.1, 322.2, 403/322.3

See application file for complete search history.

(56) References Cited

U.S. PATENT DOCUMENTS

| | | | | |
|---|---|---|---|---|
| 1,076,800 | A | | 10/1913 | Waymire |
| 1,245,990 | A | | 11/1917 | Shannahan |
| 1,605,008 | A | | 11/1926 | Smith |
| 1,609,414 | A | * | 12/1926 | Lenny ..... 15/143.1 |
| 1,781,460 | A | | 11/1930 | Hertzberg |
| 2,328,287 | A | | 8/1943 | Martin |
| 2,724,852 | A | | 11/1955 | Clark |
| 2,900,652 | A | | 8/1959 | Kautenberg |
| 3,203,029 | A | * | 8/1965 | Serio ..... 16/422 |
| 3,208,318 | A | | 9/1965 | Roberts |
| 3,221,356 | A | | 12/1965 | Schimer |
| 3,395,415 | A | | 8/1968 | Leland |

(Continued)

FOREIGN PATENT DOCUMENTS

DE 19908259 A1 8/2000

(Continued)

OTHER PUBLICATIONS

Patent Abstracts of Japan, JP 08228985 A, Sep. 10, 1996.

(Continued)

*Primary Examiner*—Mark Spisich
(74) *Attorney, Agent, or Firm*—Nathan P. Hendon

(57) ABSTRACT

A quick-release handle for use with the working head of a cleaning tool is disclosed. The handle includes a quick-release coupling assembly positioned on one end of the handle and a button actuator positioned on the opposite end of the handle. The coupling assembly is configured to releaseably couple with a working head. The button actuator is operably connected to the coupling assembly such that coupling assembly may be disengaged from a working head through manipulation of the button actuator.

20 Claims, 8 Drawing Sheets

U.S. PATENT DOCUMENTS 3,605,161 A 9/1971 Moss et al.
3,737,938 A 6/1973 Saltzstein
3,753,267 A 8/1973 Johnson, Sr.
3,778,860 A 12/1973 Thielen
3,837,031 A 9/1974 Allaire et al.
3,849,825 A 11/1974 Shortte, Jr.
3,850,533 A 11/1974 Thielen
4,114,223 A 9/1978 Buchanan
4,196,488 A 4/1980 Barry
4,225,998 A 10/1980 Thielen
4,247,216 A * 1/1981 Pansini ..... 403/109.3
4,353,142 A 10/1982 Nishiyama et al.
4,433,931 A 2/1984 Malish et al.
4,523,347 A 6/1985 Tames
D281,361 S 11/1985 Jaros et al.
4,685,167 A 8/1987 Murray
4,763,377 A 8/1988 Madsen
4,819,293 A 4/1989 Nicholson
4,852,210 A 8/1989 Krajicek
4,962,682 A 10/1990 Rose et al.
4,964,186 A 10/1990 Stuck
4,995,134 A 2/1991 Monahan
5,071,489 A 12/1991 Silvenis et al.
5,207,754 A 5/1993 Harrah
5,288,161 A 2/1994 Graves et al.
D348,827 S 7/1994 Berti et al.
5,343,587 A 9/1994 Findley
5,375,286 A 12/1994 Harrah
5,379,478 A 1/1995 Vosbikian
5,394,594 A * 3/1995 Duran ..... 24/453
5,419,015 A 5/1995 Garcia
5,442,830 A 8/1995 Ohm
5,455,980 A 10/1995 Buchanan
5,461,749 A 10/1995 Ahlberg et al.
D366,740 S 1/1996 Clausen et al.
5,581,839 A 12/1996 Ferrell, Jr.
5,701,628 A 12/1997 Morad
5,740,578 A 4/1998 Moore
D398,724 S 9/1998 Kohlruss et al.
5,842,810 A 12/1998 Morad
5,876,141 A 3/1999 Hsu
5,901,402 A 5/1999 Williams
5,911,258 A 6/1999 Morad
5,920,944 A 7/1999 Biggs et al.
5,937,471 A 8/1999 Liao
6,023,812 A 2/2000 Morad
6,029,308 A 2/2000 Smith
6,119,298 A 9/2000 Kenmochi
6,161,242 A 12/2000 Cabrero Gomez et al.
6,212,917 B1 4/2001 Rathbun
6,237,182 B1 5/2001 Cassar
6,298,517 B1 10/2001 McKay
6,305,046 B1 10/2001 Kingry et al.
D458,722 S 6/2002 Romero et al.
D465,890 S 11/2002 Rivera et al.
6,481,042 B1 11/2002 Hsieh
6,484,346 B2 11/2002 Kingry et al.
6,513,199 B1 * 2/2003 Cheng ..... 16/436
6,637,065 B2 10/2003 Biggs
6,654,980 B2 12/2003 Biggs
6,736,034 B1 5/2004 Gonzales
6,745,427 B1 6/2004 Trenz et al.
6,772,468 B1 8/2004 Psik et al.
6,810,554 B2 11/2004 McKay
6,820,301 B2 11/2004 Petner
6,842,936 B2 1/2005 Policicchio et al.
6,854,919 B2 2/2005 Neumann et al.
6,871,372 B2 3/2005 Vosbikian et al.
6,889,917 B2 5/2005 Fahy et al.
6,925,686 B2 8/2005 Heathcock et al.
6,953,299 B2 10/2005 Wang et al.
6,976,282 B2 12/2005 Sie
6,986,618 B2 1/2006 Hall et al.
7,065,825 B2 * 6/2006 Minkler et al. ..... 15/210.1
2001/0009632 A1 7/2001 Cross
2003/0009839 A1 1/2003 Streutker et al.
2003/0028988 A1 2/2003 Streutker et al.
2003/0084531 A1 5/2003 Dingert et al.
2003/0097725 A1 5/2003 Smith
2003/0110584 A1 6/2003 Clare et al.
2003/0140441 A1 7/2003 Stafford
2004/0068817 A1 4/2004 Policicchio
2004/0074520 A1 4/2004 Truong et al.
2004/0088808 A1 5/2004 Vitantonio et al.
2004/0182952 A1 9/2004 Soller et al.
2004/0188539 A1 9/2004 Soller et al.
2004/0244131 A1 12/2004 Cassar
2004/0255418 A1 12/2004 Minkler et al.
2005/0060827 A1 3/2005 James et al.
2005/0066465 A1 3/2005 Minkler et al.
2005/0097691 A1 5/2005 Tsuchiya et al.
2005/0102781 A1 5/2005 Tsuchiya et al.
2005/0251941 A1 11/2005 Berhoff
2005/0251943 A1 11/2005 VanLandingham, Jr.
2005/0265769 A1 12/2005 Blom
2005/0283933 A1 12/2005 Mitchell et al.
2005/0285387 A1 12/2005 Suda et al.
2006/0000041 A1 1/2006 Streutker et al.
2006/0048327 A1 3/2006 Lacotta et al.
2006/0075587 A1 4/2006 Broman
2006/0191557 A1 8/2006 Rosenzweig et al.

FOREIGN PATENT DOCUMENTS

EP 0697269 A2 2/1996
EP 0980667 A2 2/2000
EP 0811350 B1 11/2000
EP 0966222 B1 9/2003
EP 1591053 A1 11/2005
FR 2575058 A 6/1986
GB 2259474 3/1993
WO WO 88/01845 3/1988
WO 99/49755 * 10/1999
WO WO 99/60913 12/1999
WO WO 03/039321 5/2003
WO WO 2004/071266 8/2004
WO WO 2005/084516 9/2005
WO WO 2006/002653 1/2006

OTHER PUBLICATIONS

Patent Abstracts of Japan, JP 10276953 A, Oct. 20, 1998.
Patent Abstracts of Japan, JP 2001309881 A, Nov. 6, 2001.
Patent Abstracts of Japan, JP 2002102132A, Apr. 9, 2002.

* cited by examiner

QUICK-RELEASE HANDLE AND INTERCHANGEABLE CLEANING SYSTEM

BACKGROUND

Long shaft handles have been used as a part of various tools for as long as tools have been used. Such handles allow maintenance personnel to clean floors while in a standing position when the handle is attached to a mop head, or allows a painter to paint a ceiling when the handle is attached to a paint roller. Generally, each tool working head is fitted with its own handle such that a person with a collection of various tools will often have a closet, cabinet, wall rack or garden shed cluttered with a collection of such handles, each attached to its own tool working head. For example, building maintenance personnel may require a collection of wet mops, dry dust mops of various widths, squeegees, brooms, and other such items, each with its own handle. Such a collection of tools can create a cluttered maintenance closet or may be cumbersomely attached to a maintenance cart.

Often the working head attached to such handles will wear out or may otherwise be designed to be replaced. In the case of wet mops and dry dust mops, the heads are designed to be used a discreet number of times before the head must be cleaned or replaced. The handles are commonly attached to the working head with rivets, bolts, screws, and the like. Removing and replacing the working head can often be a time consuming task, may require tools that the user does not have readily available, and/or may be beyond the technical capabilities of the user.

In the case of many wet mops, dry dust mops, and brooms, the handle is often attached to the working head with a threaded tip at the end of the handle that mates with a threaded socket. However, while the connection and disconnection of such a handle is simple, it can be cumbersome and frustrating to the user, especially when the handle loosens from the head during use.

Some wet string or sponge mops utilize various brackets, clamps, screws, support bars, and the like, to hold a disposable mopping substrate at the working end of the handle. However, the replacement of the mopping substrate often can be difficult and commonly requires the user to handle, touch, or otherwise manipulate the dirty mopping substrate.

Others have attempted to solve the inconvenience of switching working heads by employing quick connect and release mechanisms to join various types of working heads to handles. Such quick connects often use a male connector that is mated with a female fitting. Commonly, the male connector will include opposing end portions that will snap into matching slots or holes in the female fitting such that the end portions are pinched together to subsequently release the male connector from the female fitting. However, the problem with this, or other such common quick connect and release designs, is that the user has to manipulate the tool where the working head is connected to the handle. Often this is the "dirty" end of the tool (e.g., close to the used mop head) and minimally requires that the user bend over or reposition the tool to be able to so manipulate the quick release.

Finally, another related problem associated with the regular use of long-handled tools such as mops, brooms, and the like, is related to wear and fatigue to the user's hands. During regular use of a mop, broom or other similar tool, the end of the tool regularly twists and rubs on the user's hand. If the user is not wearing gloves, such repeated use often leaves painful calluses or blisters on the palm of the user's hand.

Definitions

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "couple" includes, but is not limited to, joining, connecting, fastening, linking, or associating two things integrally or interstitially together.

As used herein, the term "configure(s)", "configured" or "configuration(s)" means to design, arrange, set up, or shape with a view to specific applications or uses. For example: a military vehicle that was configured for rough terrain; configured the computer by setting the system's parameters.

As used here, the term "operable" or "operably" means being in a configuration such that use or operation is possible. Similarly, "operably connect(s)" or "operably connected" refers to the relation of elements being so configured that a use or an operation is possible through their cooperation. For example: the machine is operable; the wheel is operably connected to the axle.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As user herein, the terms "orientation" or "position" used interchangeably herein refer to the spatial property of a place where or way in which something is situated; for example, "the position of the hands on the clock."

These terms may be defined with additional language in the remaining portions of the specification.

SUMMARY OF THE INVENTION

In light of the problems and issues discussed above, it is desired to have a handle that can work with a variety of working heads. It is also desired that such a handle be capable of quickly changing between various working heads and have a quick-release that allows such a change without the user having to come in close contact with the working head. It is also desired that the handle be designed to prevent calluses and blisters caused by the end of traditional handles during prolonged or repeated use.

The present invention is directed to a quick-release handle adapted for use with a cleaning tool working head configured to receive a handle. The quick-release handle includes a hollow elongated shaft with a quick-release coupling assembly on one end of the shaft and a button actuator on the opposite end of the shaft. The coupling assembly is configured to releaseably couple the handle to a socket mount. The button actuator is operably connected to the quick-release coupling assembly such that when the button actuator is depressed, the coupling assembly is disengaged from the socket mount.

In various embodiments of the present invention, the handle may additionally include a coupler shroud, the button actuator may be recessed within the end of the shaft, and the handle may include an ergonomic, freely-rotating knob. In some embodiments, the socket mounts may include a retention stop that engages the quick-release coupling assembly. In some embodiments, the socket mounts may be threaded. Finally, the socket mount may include a spring that is compressed when the quick-release coupling assembly of a handle is inserted into the socket mount, the spring being biased to push the coupling assembly from the socket mount.

In some embodiments of the present invention, the handle may be a part of a cleaning tool system that includes a working head coupled to the socket mount. Such working heads may include dry mop heads, wet mop heads, brooms, paint rollers, light bulb changers, and squeegees. The individual working heads may further include a head coupler that connects the working head to the socket mount and allows the handle to move up and down and from side to side relative to the working head. Additionally, the socket mounts of such working heads may be configured to cooperatively engage a coupler shroud present on the quick-release handle.

The present invention is also directed to a cleaning system including a quick-release handle and a plurality of working heads, each working head including a socket mount configured to cooperate with the quick release handle. In various embodiments, the plurality of working heads may include a plurality of mop heads of various widths.

In some embodiments, the system may include a continuous web of cleaning substrate to be used with the plurality of mop heads, the continuous web having lines of weakness at regular intervals such that various widths of cleaning substrate are removable via the lines of weakness. Such a system may additionally include a container in which the continuous web of cleaning substrate may be contained and from which the substrate may be dispensed. Additionally, such a container may include a separator that assists in separating individual cleaning substrates from the continuous web of cleaning substrate.

DETAILED DESCRIPTION

Figure 1:
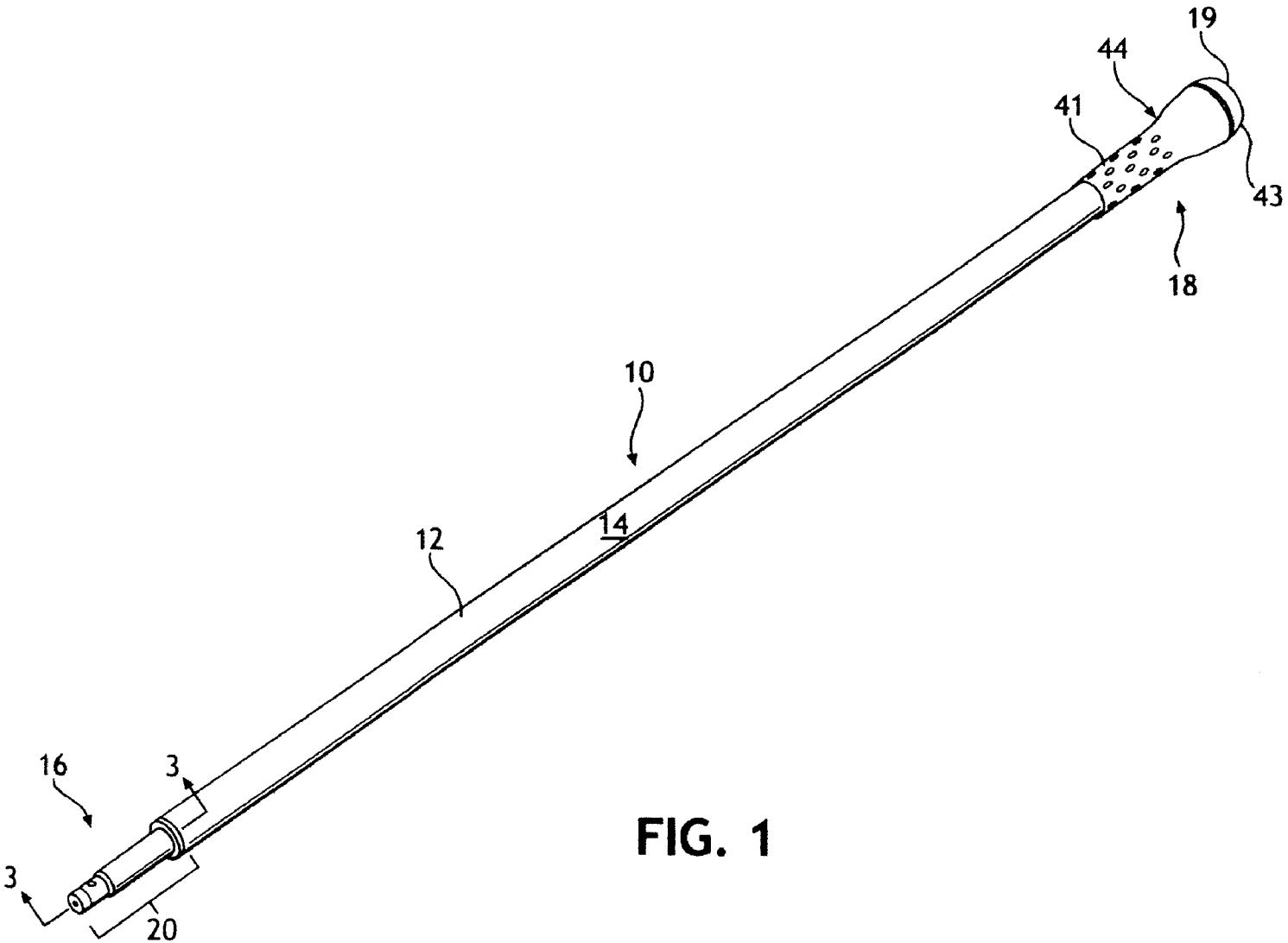
FIG. 1 is a perspective view of a quick-release handle of the present invention.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to FIGS. 1 to 5 in general, the quick-release handle 10 of the present invention includes an elongated shaft 12 having two opposite ends; a proximal end 16 and a distal end 18. The proximal end 16 is proximate to the working head to which the handle 10 is to be attached. The distal end 18 is distal to the proximal end 16 and proximate to the user. The proximal end 16 includes the quick-release coupling assembly 20 that will cooperate with and couple the handle 10 to a working head. The proximal end 16 is also considered as the attachment end of the handle 10 and the terms "proximal end" and "attachment end may be used interchangeably.

Generally, the distal end 18 will have a grip 41 by which the user may grasp the handle 10. The distal end 18 is also considered the grip end of the handle 10 and the terms "distal end" and "grip end" may be used interchangeably. Additionally, the distal end 18 accommodates the button actuator 45 which the user depresses to release the coupling assembly 20 from any working head that may be coupled with the proximal end 16 of the handle 10. Thus, the user can release a working head from the handle 10 by manipulating the distal end 18 rather than repositioning the handle, bending over, or going anywhere near the potentially dirty proximal end 16 of the tool.

The elongated shaft 12 is shown in FIG. 1 as generally cylindrical in shape, having a circular cross-section, as is common for most commonly available long tool handles. As such, the elongated shaft 12 has a single peripheral surface 14. However, other cross-sectional shapes are contemplated and are considered within the scope of the present invention. By way of non-limiting examples, the cross-sectional shape of the elongated shaft 12 may be elliptical, polygonal, or any other symmetrical or asymmetrical shape. Any such alternative cross-sectional shape may provide the elongated shaft 12 with additional peripheral surfaces 14.

Generally, it is desired that the elongated shaft 12 have a length of about 36 inches (0.9 m) to about 72 inches (1.8 m). For a quick-release handle 10 for use with cleaning tool working heads, the elongated shaft will preferably be about 5 feet (1.5 m) in length, similar to the length of commonly available tool handles. The elongated shaft 12 should have an outside diameter suitable for the intended tool working heads and that is comfortable for use by range of user hand sizes. Typically, the outside diameter will be in the range of about 0.5 inches (12.7 mm) to about 1.5 inches (38.1 mm). Preferably, the outside diameter of the shaft 12 will be similar to that of commonly available handles, 0.75 inches (19.1 mm). Also, the shaft 12 illustrated in FIG. 1 is generally uniform in its diameter from the proximal end 16 to the distal end 18. However, the shaft 12 may alternatively have a non-uniform diameter along its length and may have sections of uniform and non-uniform diameter along its length.

The elongated shaft 12 is hollow to accommodate the push rod 31 and the other associated elements of the button actuator 45 and quick-release coupling assembly 20. The hollowed nature of the shaft 12 also decreases the weight of the handle 10 and the amount of material used in making the handle 10. The thickness of the hollow elongated shaft 12 is a function of the materials used to make the shaft 12, the inside diameter required to accommodate the elements to be accommodated within the shaft 12, and the strength and weight desired. One skilled in the art would see how such variables could be balanced to produce the desired shaft 12.

The elongated shaft 12 may be made from any material that meets the needs of the various working heads with which such a handle 10 is expected to be used. For example, a stronger shaft 12 may be desired for commercial applications while a lighter shaft may be desired for home applications. Other considerations may include, but are not limited to, weight, durability, compatibility with chemicals and substances the handle may come in contact, appearance, ease of cleaning, colors available, disposability, and the like. Typically, the shaft 12 may be made of a metal, plastic, or wood. More particularly, the shaft 12 may be made of aluminum, stainless steel, ABS-plastic, or the like. Again, one skilled in the art would see how such variables could be balanced to produce the desired shaft 12.

Additionally, designs in which the shaft 12 is telescoping, collapsible, and/or foldable are also considered to be within the scope of the present invention.

As discussed above, the quick-release coupling assembly 20 is positioned on the proximal end 16 of the handle 10 and is configured to be coupled with a working head. The coupling assembly 20 may utilize any releasable coupling mechanism, as are well known, to releaseably couple with a working head. By way of non-limiting examples, such a releasable coupling mechanism may utilize a detent ball assembly (as illustrated in FIGS. 2, 3A and 3B), a collet, a chuck, a clamping spring, a bayonet mount, a barbed fastener, a ribbed shank clip fastener, or other such mechanisms or any combination thereof.

The mechanism of the coupling assembly 20 is actuated by the user pressing and releasing the button actuator 45 on the distal end 18 of the shaft 12. The button actuator 45 is operably connected with the coupling assembly 20 by the push rod 31 which extends along the length of the shaft 12, from the button actuator 45 to the coupling assembly 20. As can be seen in the example illustrated in FIGS. 2, 3A, 3B, 4A, 4B and 5, the button actuator 45 is the terminus of the push rod 31 on the distal end 18 of the handle 10. At the proximal end of the push rod 31, a stop collar 33 is fitted around and attached to push rod 31 by a pin 34. A spring 35 around the push rod 31 and compressed between the stop collar 33 and the end wall of the stepped tip 21 of the coupling assembly 20 keeps the push rod 31 biased toward the distal end 18.

Figure 2:
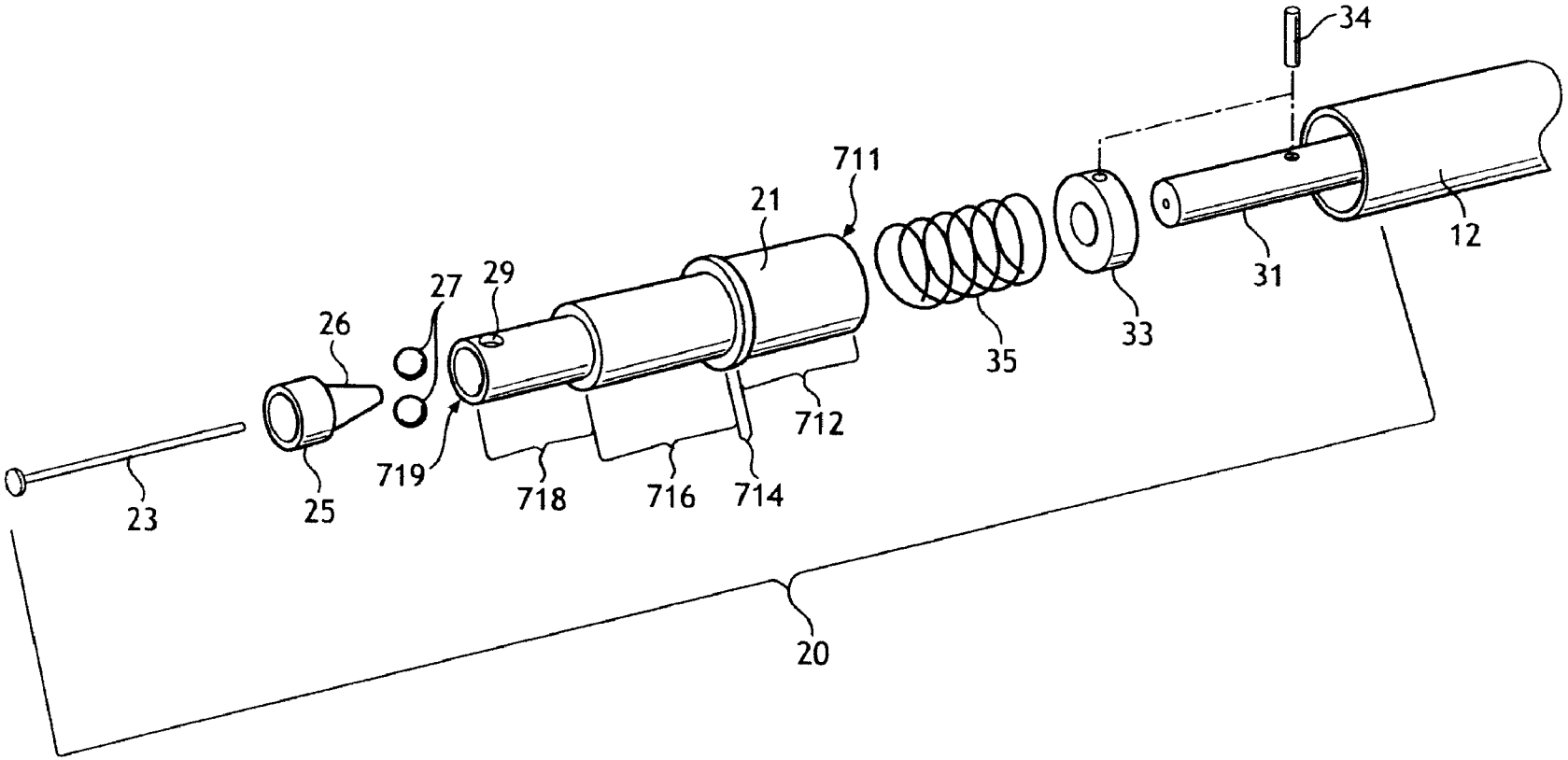
FIG. 2 is a partial perspective exploded view of a quick-release coupling assembly of the handle of FIG. 1.
Figure 3A:
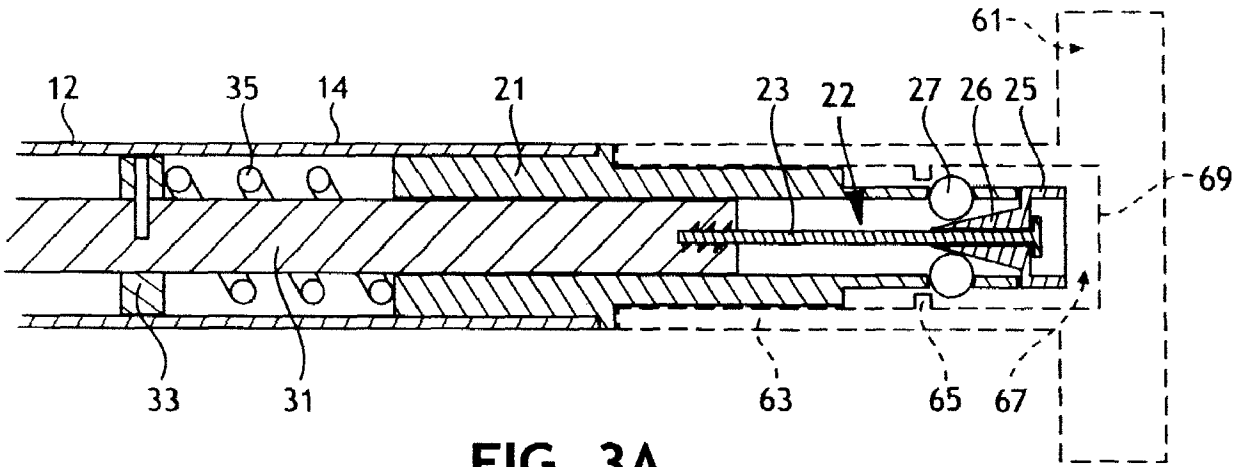
FIG. 3A is a cross-sectional view of a quick-release coupling assembly of the handle of FIG. 1 taken along line 3-3, shown in an engaged configuration with a generic socket mount (illustrated by phantom lines)
Figure 3B:
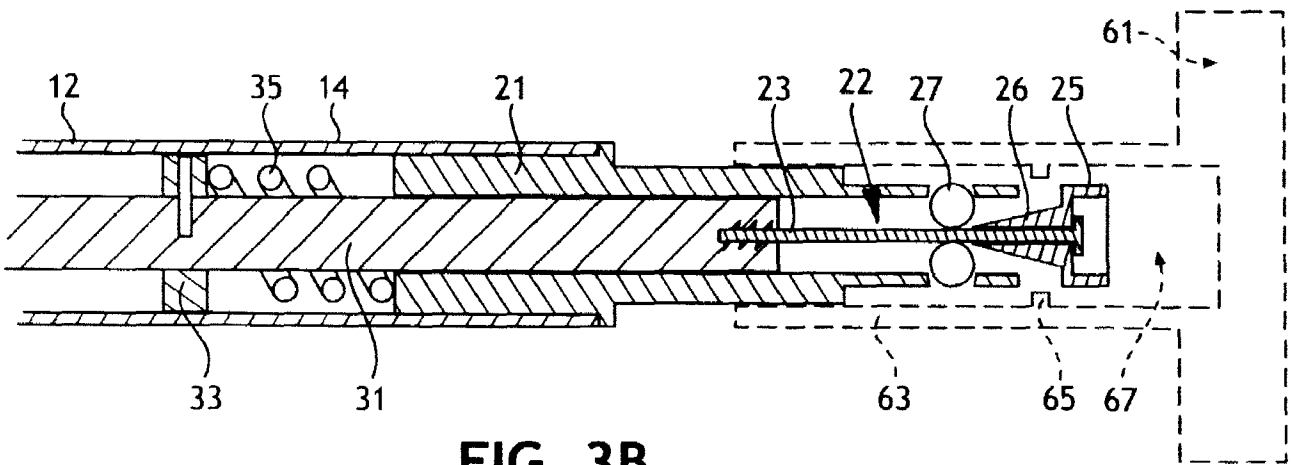
FIG. 3B is a cross-sectional view of the quick-release coupling assembly of the handle of FIG. 1 taken along line 3-3, shown in a release configuration in relation to the generic socket mount (illustrated by phantom lines)

As shown in FIGS. 2, 3A, and 3B, the coupling assembly 20 at the proximal end 16 of the shaft 16 includes a stepped tip 21 having a first end 711 inserted into the proximal end 16 of the shaft 12 and a second end 719 that extends from the end of the shaft 12 and into the socket mount 63 of a head mount 61 of a working head to which the handle 10 is to be coupled. The stepped tip 21 has an internal longitudinal channel 22 that extends the length of the stepped tip 21, from the first end 711 to the second end 719. The first section 712 of the stepped tip 21 near the first end 711 has a diameter slightly smaller than the inside diameter of the shaft 12 such that the stepped tip 21 may be snuggly fit into the proximal end 16 of the shaft 12. A lip section 714 of the stepped tip 21 seats the stepped tip 21 in the proximal end 16 of the shaft 12 and prevents the stepped tip 21 from being pushed further into the shaft 12.

As illustrated in FIGS. 3A and 3B, once the stepped tip 21 is installed in the shaft 12, the push rod 31 extends into the longitudinal channel 22 of the stepped tip 21. A stop rod 23 extends from the proximal end of the push rod 31 and is attached to the end of the push rod 31. The stop rod 23 extends out of the longitudinal channel 22 at the second end 719 of the stepped tip 21 and is capped by a head portion 25. The head portion 25 has a conical portion 26 that extends around the stop rod 23 inside the longitudinal channel 22. When the stop rod 23 is attached to both the push rod 31 and the head portion 25, the spring 35 that biases the push rod 31 toward the distal end 18 (as discussed above) also pulls the head portion 25 against the second end 719 of the stepped tip 21.

The third section 718 of the stepped tip 21 additionally includes ports 29 that extend from the longitudinal channel 22 to the outer surface of the stepped tip 21. A single detent ball 27 is retained by each port 29 and against the stop rod 23 or the conical portion 26.

When the handle 10 and coupling assembly 20 are in the engaged configuration, such as shown in FIG. 3A, the spring 35 between the stop collar 33 and the first end 711 of the stepped tip 21 biases the push rod 31 toward the distal end 18 of the shaft 12. The stop rod 23 attached to both the head portion 25 and the push rod 31 is subsequently pulled into contact with the second end 719 of the stepped tip 21. The head portion 25 is only pulled to the second end 719 and thus the spring 35 cannot push the push rod 31 further toward the distal end 18 or pull the stop rod further into the stepped tip 21. In such an engaged configuration, the coupling assembly 20 and push rod 31 are held in a neutral state by the spring 35.

As shown in FIG. 3A, when the coupling assembly 20 is in the engaged state, the head portion 25 is pulled to the second end 719 of the stepped tip 21 such that the conical portion 26 of the head 25 is pulled into the longitudinal channel 22. The conical portion 26 engages the detent balls 27 and pushes them into the ports 29 such that the detent balls partially extend outside of the exterior wall of the third section 718 of the stepped tip 21.

FIG. 3B illustrates the release configuration of the handle 10 and coupling assembly 20. When the user depresses the button actuator 45 at the distal end 18, the push rod 31 and the stop collar 33 is pushed toward the proximal end 16 of the shaft 12, compressing the spring 35 between the stop collar 33 and the first end 711 of the stepped tip 21. The stop rod 23, including the head 25, is consequently pushed away from the second end 719 of the stepped tip 21. As the conical portion 26 of the head 25 is pushed toward the second end 719, the detent balls 27 are allowed to fall back into the longitudinal channel 22 and against the stop rod 23. When the user releases the button actuator 45, the spring 35 returns the handle 10 to the engaged, or neutral, configuration as illustrated in FIG. 3A.

Figure 9:
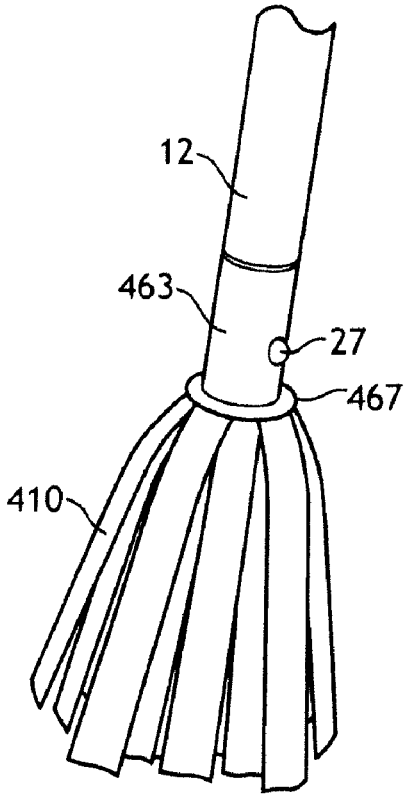
FIG. 9 is a partial perspective view of the proximal end of the quick-release handle coupled to a wet mop working head.

Various working heads could be used with this type of handle 10 and coupling assembly 20. To work with the coupling assembly 20, the particular working head should include a head mount 61 that includes a socket mount 63 into which the coupling assembly 20 may be inserted. A retention stop 65 within the socket mount 63 cooperatively engages with the coupling assembly 20 to securely couple the working head and the quick-release handle 10. Such a retention stop 65 may be anything within the socket mount 63 that cooperatively engages the detent balls 27 of the coupling assembly 20. By way of non-limiting examples, the retention stop 65 may be a ring fixed within the socket mount 63 (as shown in FIGS. 3A and 3B), recesses within the wall of the socket mount 63, holes in the socket mount 63 (as shown in FIG. 9), or another configuration which can engage the detent balls 27.

In operation, when the coupling assembly 20 is inserted into the socket mount 63, the stepped tip 21 would proceed from the mouth of the socket recess 67 toward the recess terminus 69. When the coupling assembly 20 is in the engaged (neutral) configuration, the detent ball 27 are pushed out of the ports 29 by the conical portion 26 of the head 25, as discussed above. The inside diameter of the ring used as the retention stop 65 shown in FIGS. 3A and 3B is designed to be slightly larger than the outer diameter of the third portion 718 of the stepped tip 21. Thus, as the stepped tip 21 is inserted into the socket mount 63, the third portion 718 snugly passes into the retention stop 65, but the protruding detent balls 27 will come into contact with the retention stop 65. As the user continues to apply insertion pressure to the stepped tip 21, the detent balls 27 are forced into the ports 29 and push against the conical portion 26 and consequently push the head 25 from the second end 719. Once the stepped tip 21 is pushed farther into the socket mount 63, the detent balls 27 clear the retention stop 65 and are again forced out of the ports 29 by the conical portion 26. The detent balls 27 engage the retention stop 65 as illustrated in the engaged configuration shown in FIG. 3A.

The socket mount 63 includes a socket recess 67 on the recess terminus side of the retention stop 65. Such a recess 67 allows enough room for the head 25 to extend from stepped tip 21 as necessary for the detent balls 27 to drop inside the stepped tip 21 during insertion of the coupling assembly 20 or release of the working head, as discussed above.

The use of a coupling assembly 20 with the detent ball 27 mechanism described and illustrated in FIGS. 2, 3A and 3B, is only one possible coupling assembly 20 that may be used in the handle 10 of the present invention. As discussed above, other coupling mechanisms are contemplated for the coupling assembly 20 to couple the handle 10 with a working head and operably connect to the button actuator 45 such that the working head is released from the handle 10 when the button actuator 45 is manipulated.

For increased universality, the socket mount 63 may additionally be threaded from the mouth of the socket mount 63 to the retention stop 65. Such a socket mount 63 could then also accept a standard handle with a thread tip, if the user so desired.

The second section 716 of the stepped tip 21 is designed to have an outside diameter slightly smaller than the inside diameter of the socket mount 63. This ensures that the coupling assembly 20 snuggly fits within the socket mount 63 such that the working head is securely and solidly held at the end of the handle 10. If the socket mount 63 is threaded, the second section 716 would need to have an outside diameter slightly smaller that the threads.

Although not shown, a second spring could be included inside of the socket mount 63, attached to the recess terminus 69. Such a spring would be compressed upon insertion of the coupling assembly 20 into the socket mount 63. When the button actuator 45 was subsequently pressed to release the working head from the handle 10, such a spring would then bias the socket mount 63 off of the coupling assembly 20.

Additional stability may be added to the connection of the head mount of the working head and the coupling assembly 20 by the inclusion of a coupler shroud 71 at the proximal end 16 of the shaft 12. As shown generally in FIGS. 6A, 6B, 7 and 8, the coupler shroud 71 has portions that both protect the exposed coupling assembly 20 from damage and cooperate with the designs of the head mounts to securely couple the working head and handle 10.

Figure 6A:
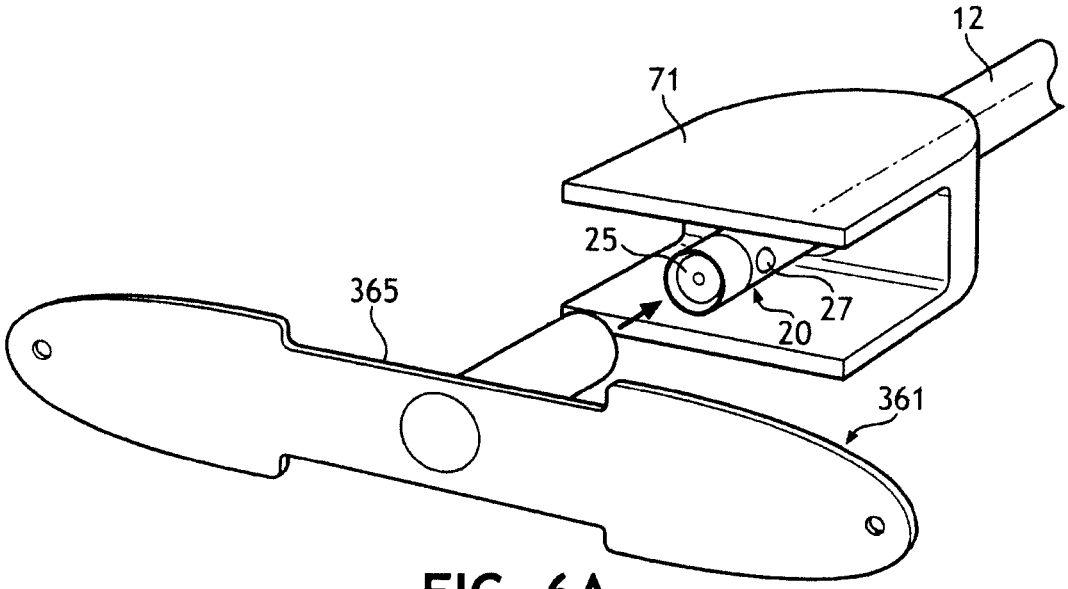
FIG. 6A is a partial perspective view of the proximal end of the quick-release handle, the proximal end including a coupler shroud and positioned to engage a head mount.
Figure 6B:
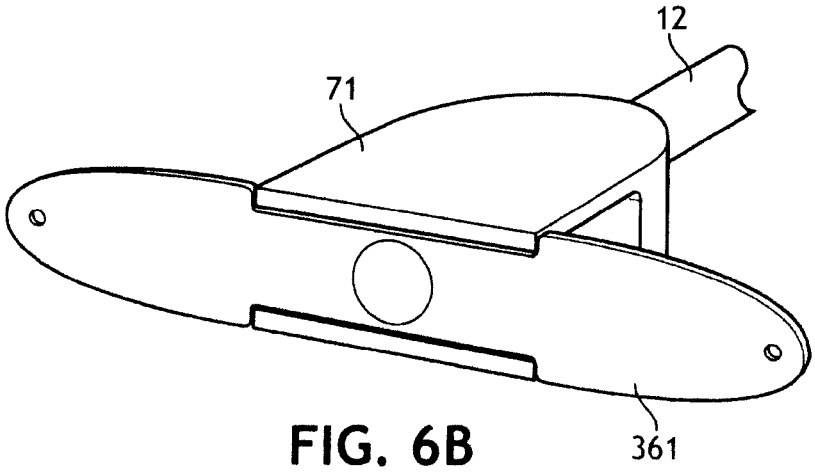
FIG. 6B is a partial perspective view of the proximal end of the quick-release handle of FIG. 6A showing the coupler shroud coupled to the head mount.

FIGS. 6A and 6B show an example of the coupler shroud 71 protecting the coupling assembly 20 on the proximal end 16 of a shaft 12. A wet mop head mount 361 is also shown, without the mop substrate attached to the head mount 361. Such a head mount 361 has shoulder portions 365 that cooperatively engage with the head shroud 71. As shown in FIG. 6B, once the head mount 361 is engaged, the head mount 361, consequently the wet mop head including the head mount 361 is not able to rotate about the shaft axis.

Figure 7:
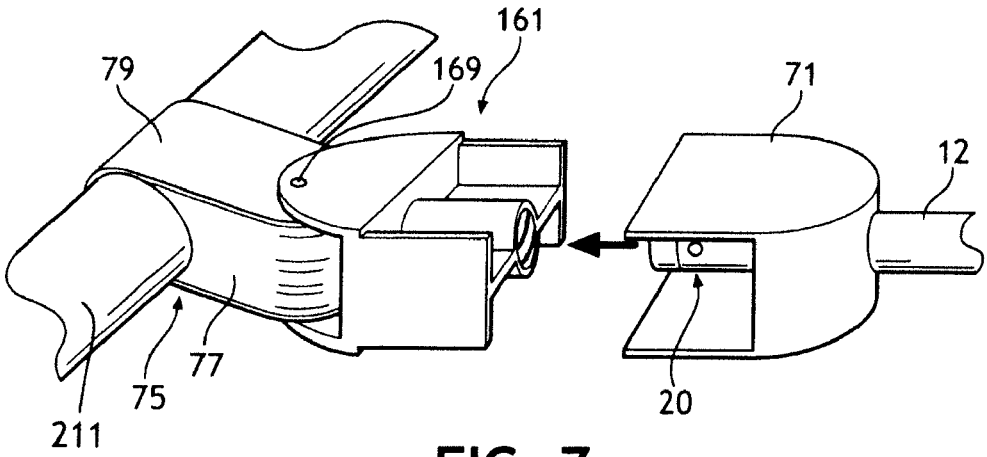
FIG. 7 is a partial perspective view of the proximal end of the quick-release handle, the proximal end including a coupler shroud and positioned to coupled to a head mount, the head mount including a head coupler.
Figure 8:
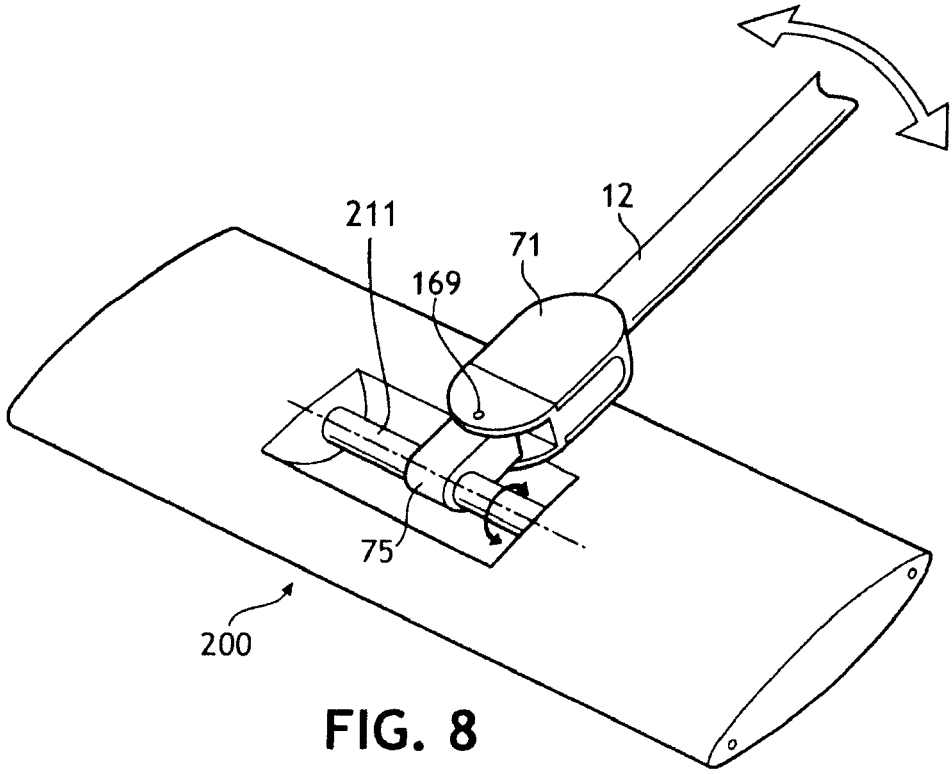
FIG. 8 is a partial perspective view of the proximal end of the quick-release handle including a coupler shroud and coupled to a dry mop working head.

Another example of a coupler shroud 71 and cooperating head mount is shown in FIGS. 7 and 8. The illustrated coupler shroud 71 and the head mount 161 are cooperatively designed such that coupler shroud 71 fits within the head mount 161 and the head mount 161 fits within the coupler shroud 71. Such a cooperative design ensures a snug and solid coupling of the working head attached to the head mount 161 and the handle 10. Such a working head would be unable to rotate about the shaft axis. Additionally, such a head mount 161 along with the coupler shroud 71 could help protect the coupling assembly 20 from damage and minimize the contact the coupling assembly 20 has with the outside environment during use.

As shown in FIGS. 7 and 8, additional functionality may be added to a head mount 161 by including a head coupler 75. The head coupler 75 connects the head mount 161 to the body of a working head. The particular head coupler 75 shown in FIGS. 7 and 8 has a coupler bracket 79 that fits around a portion of the head mount 161, i.e., the cross-member 211 of the dry mop head 200 in FIG. 8. A coupler spacer 77 cooperates with the coupler bracket 79 to hold the coupler bracket 79 against the cross-member 211. A pin 169 through the head mount 161, coupler bracket 79, and the coupler spacer 77 couples the head mount 161 and head coupler 75.

The head coupler 75, illustrated in FIGS. 7 and 8, allows the head coupler 75, the attached head mount 161, and the coupled quick-release handle 10 to rotate about the cross-member 211 and consequently allow the distal end 18 of the handle 10 to move vertically relative to the floor and the mop head 200. Additionally, the head coupler 75 is designed to interact with the head mount 161 such that the head mount 161 and coupled handle 10 may pivot on the pin 169 of the head coupler 75, such that the distal end 18 of the handle 10 may be pivoted from side-to-side, relative to the mop head 200.

To aid the user in grasping the handle 10, the distal end 18 may be equipped with a grip 41 and a knob 43. The grip 41 has a slightly larger diameter than the shaft 12 and is preferably made of material, or is otherwise designed, to facilitate grasping of the shaft 12. Additionally, such a grip 41 should be designed to have the necessary durability required for the typical use of such handle 10. For example, the grip 41 may be made of rubber, plastic, metal, or the like. Such materials may be given a texture through processing or through design by the addition of ridges, patterns, or divots to the surface of the grip 41 (as shown in FIGS. 4A and 4B).

The grip 41, as shown in FIGS. 1, 4A, 4B and 5, may additionally have a knob 43 that also provides the user with more comfort than a traditional stick used with common brooms or mops. Generally, such traditional sticks merely have the end rounded off and cause fatigue to the user's hand and often result in blisters or calluses in the palm of the hand after extended use. The small diameter of the end of such traditional sticks causes discomfort and is often difficult for the user to fully grasp.

Figure 4A:
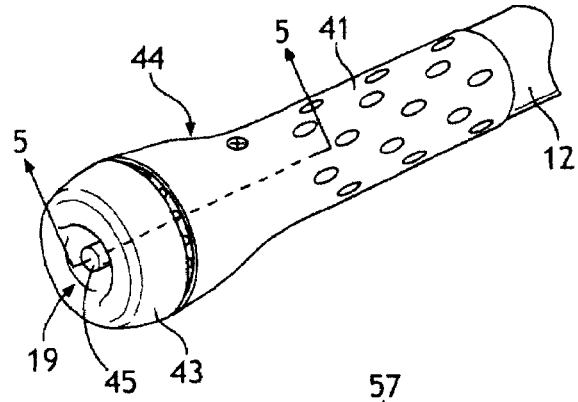
FIG. 4A is a partial perspective view of the distal end of the quick-release handle of FIG. 1 showing a grip, a freely-rotating knob, and a button actuator.
Figure 4B:
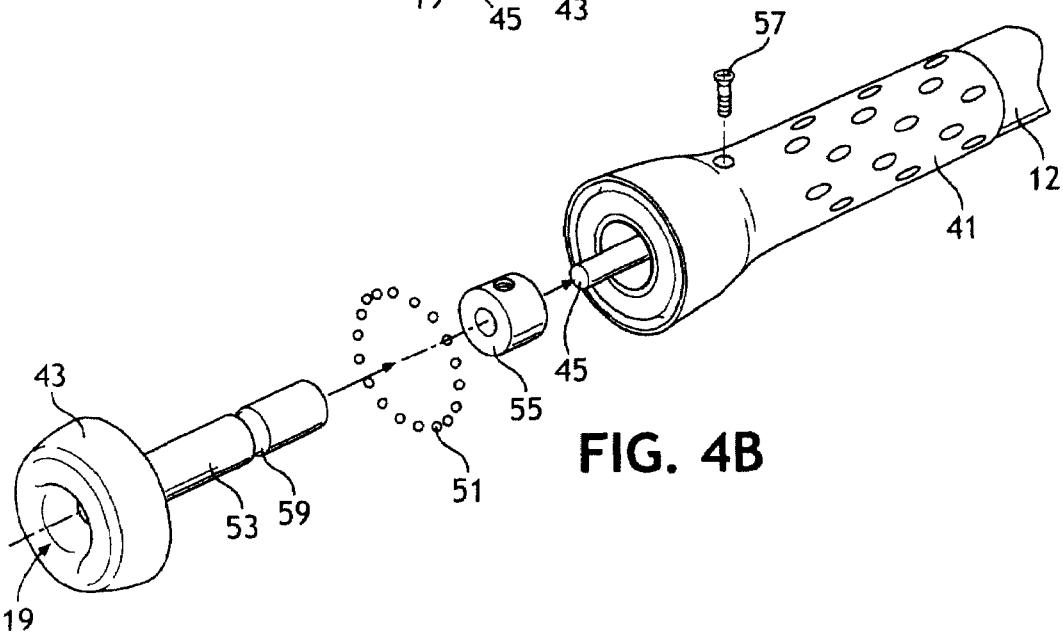
FIG. 4B is a partial perspective exploded view of the distal end of the quick-release handle of FIG. 4A.
Figure 5:
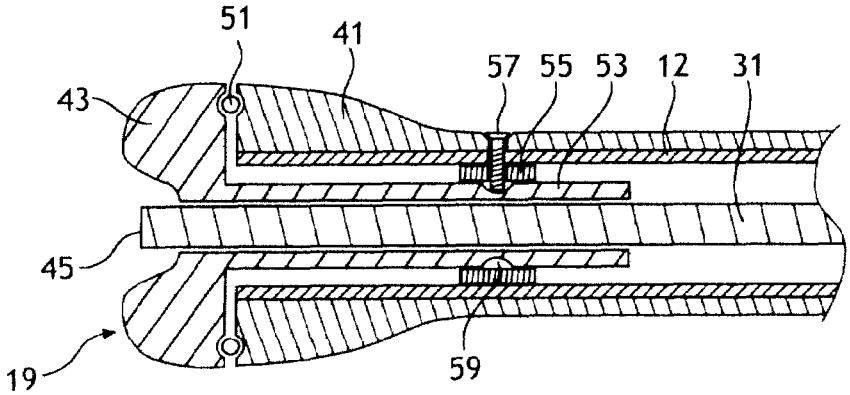
FIG. 5 is a cross-sectional view of the distal end of the quick-release handle of FIG. 4A taken along the line 5-5.

A knob 43 such as shown in FIGS. 4A, 4B and 5, provides the user with a much larger diameter end to the handle 10 compared to traditional sticks. The larger diameter of the knob 43, relative to traditional sticks makes the knob 43 much easier to grasp. By increasing the surface area of the distal end surface 19 of the knob 43, the forces experienced by the user's hand are spread out over a greater surface area than can be achieved by a rounded end of a traditional stick. Such a better distribution of forces result in a reduction in the amount of fatigue the user experience in their hand.

The knob 43 may be formed as a unitary part of the terminus of the grip 41 or it may be an additional part added to the distal end 18 of the shaft 12. The knob 43 shown in FIGS. 4A, 4B and 5 is only intended to be an exemplary shape for such a knob 43; the knob 43 may be any size and shape, symmetrical or asymmetrical, that allows the user to comfortably grasp and utilize the handle 10.

As can be seen in FIGS. 1 and 4A, the shape of the knob 43 is extended to the grip 41 of the distal end 18 of the handle 10. This functional grab area 44 of the knob 43 allows a user to maintain a grip of the knob 43, when the user pushes the handle 10 away from their body. This is particularly useful in mopping when a user will regularly "cast out" a mop and then bring the handle 10 and mop back to themselves.

Additionally, the button actuator 45 is also present at the distal end 18 of the handle 10. As shown in FIGS. 4A and 5, the button actuator 45 is incorporated into the knob 43 and is recessed within the distal end surface 19. As such, the user may grasp the knob 43 during use without unintentionally depressing the button actuator 45 and accidentally releasing the working head. The button actuator 45 shown in FIGS. 4A, 4B, and 5 is merely the terminus of the push rod 31. However, the button actuator 45 may be a separate piece attached or otherwise operably connected to the push rod 31

The knob 43, as shown in FIGS. 4A, 4B and 5, may additionally have the added ability to freely rotate 360-degrees on the terminus of the distal end 18 of the shaft 12. Such a freely-rotating knob 43 would reduce the rubbing and twisting that the user's hand experiences when using traditional sticks. By allowing the knob 43 to freely rotate, the user may maintain a grasp on the knob 43 during regular use of the tool and avoid the fatigue and blisters that often accompanied use of a traditional push broom, mop, or floor duster.

The rotation of the knob 43 may be accomplished with by any type of mechanical bearings, as are well known, that allow the desired 360-degrees of free rotation. By way of non-limiting examples, the rotation may be accomplished with sliding bearings or bushings, rolling-element bearings (such as ball bearings, roller bearings, taper roller bearings), fluid bearings, magnetic bearings, or the like. In the example shown in FIGS. 4A, 4B, and 5, the rotation of the knob 43 is accomplished with a track of ball bearings 51 that are held in place by cooperative recesses in both the end of the grip 41 and in the knob 43. The ball bearings 51 allow the knob 43 to freely-rotate a full 360-degrees about the axis of the shaft 12, on the end of the grip 41.

The assembly of the freely-rotating knob 43 is illustrated in FIGS. 4A, 4B and 5. A shaft sleeve 53 is associated with the knob 43 such that the shaft sleeve 53 fits over the push rod 31 when the knob 43 and associated shaft sleeve 53 are inserted into shaft 12. A knob-connecting collar 55 inserted into the shaft 12 fits around the shaft collar 53. A set screw 57 is inserted from the exterior of the handle 10, through the grip 41, through the shaft 12, and into the knob-connecting collar 55. As such, the set screw 57, holds the knob-connecting collar 55 in place within the interior of the shaft 12. When the knob 43 and associated shaft sleeve 53 are inserted into the shaft 12, the set screw 57 is aligned with a notch 59 circumscribed on the exterior of the shaft sleeve 53. With the set screw 57 in place within the notch 59, the knob 43 is held firmly in place on the terminus of the handle 10 and against the ball bearings 51. As such the knob 43 may freely rotate 360-degrees upon the ball bearings 51, the shaft sleeve 53 is allowed to also freely rotate within the shaft 12, and the knob 43 is kept from being pulled from the end of the handle 10.

Additionally, the shaft sleeve 53 has an interior diameter that allows the push rod 31 to pass through the shaft sleeve 53 such that knob 43 and shaft sleeve 53 may freely rotate about push rod 31. As shown in FIGS. 4A and 5, the button actuator 45 is recessed within the distal end surface 19. When in use, the knob 43 freely rotates about the button actuator 45 and push rod 31 without the risk of the user unintentionally depressing the button actuator 45 or the non-rotating button actuator 45 rubbing on the palm of the user's hand.

As discussed above, the quick-release handle 10 could be a part of an interchangeable system of working heads including socket mounts that accommodate the quick-release coupling assembly 20. The user would then be able to use a myriad of working heads with the same handle 10 and thus reduce the clutter associated with each tool having its own handle. For example, the system may include a dry mop head 200 such as shown in FIG. 8 and a wet mop head using the wet mop head mount 361, such as shown in FIGS. 6A and 6B. Additionally, or alternatively, the system may include a variety of dry mop heads 200, such as shown in FIG. 8, each having a different width for the various cleaning tasks to be performed.

Another wet mop head is shown in FIG. 9 and utilizes a simpler socket mount 463 than used in the previous examples. The socket mount 463 may attach a wet mop substrate 410 by the use of a substrate attachment collar 467. As shown in FIG. 9, the socket mount 463 may have holes inside the socket to act as a retention stop 65. The detent balls 27 of the coupling assembly 20 could then engage such holes to secure the wet mop head to the shaft 12 of the handle 10.

Figure 10A:
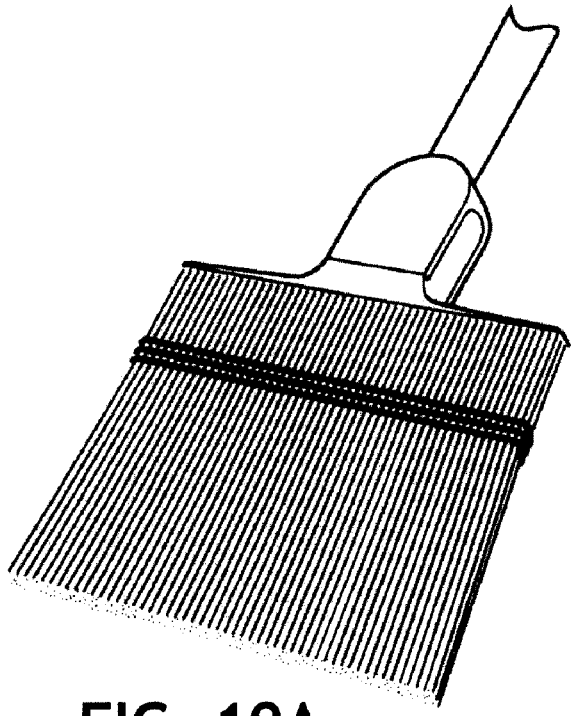
FIG. 10A is a partial perspective view of the proximal end of the quick-release handle coupled to a whisk broom working head.
Figure 10C:
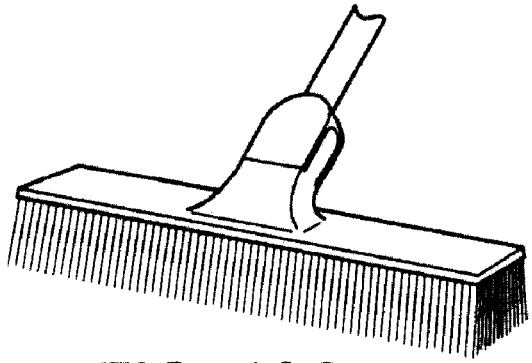
FIG. 10C is a partial perspective view of the proximal end of the quick-release handle coupled to a push broom working head.
Figure 10B:
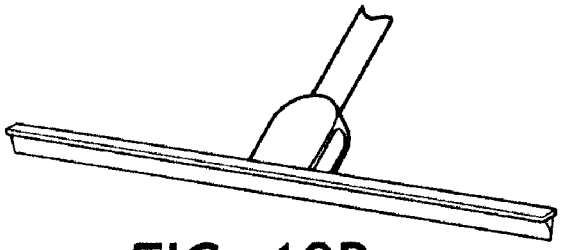
FIG. 10B is a partial perspective view of the proximal end of the quick-release handle coupled to a squeegee working head.

Besides various sizes, widths and styles of wet and dry mop heads, other working heads could be included in a system of tools that utilizes the quick-release handle 10. Non-limiting examples of other possible working heads may include a whisk broom (see FIG. 10A), a squeegee (see FIG. 10B), a push broom (see FIG. 10C), dusters, and the like. Other non-cleaning related working heads that could be used include paint roller attachments, light bulb changers, tree trimmer saws, and the like. One skilled in the art would understand that any working head/tool that utilizes a long handle could be modified to take advantage of the quick-release handle 10 of the present invention.

The interchangeable system may also include cleaning substrates for use with mop heads that use disposable substrates. Such cleaning substrates are widely available and well understood. Typically such substrates may be woven, nonwoven, laminates, composites, or combinations thereof, and may be made from natural fibers, synthetic fibers, or combinations thereof.

Such disposable cleaning substrates are most commonly provided in the size, width and design that is appropriate for the particular mop head that it is to be used. As part of an interchangeable system of working heads that includes a variety of head widths, providing a multiple substrates may be cumbersome and unwieldy. One solution is the use of a continuous web of selectable-size cleaning substrate as a part of the system.

Figure 11:
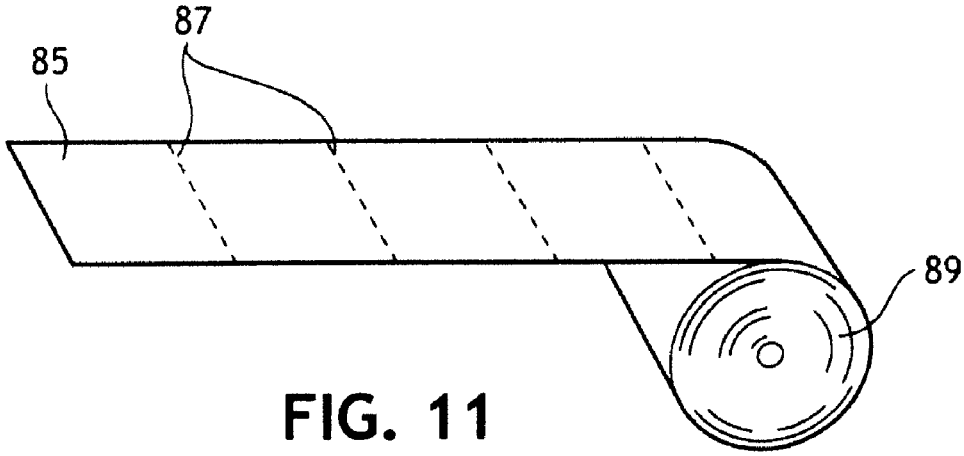
FIG. 11 is a perspective view of a continuous web of selectable-width cleaning substrate in a roll format.

As shown in FIG. 11, the continuous web of selectable-size substrate 85 may have lines of weakness 87 at regular intervals along the length of the web 85. Such lines of weakness 87 may be perforations, scoring, areas of weakened material, or other similar character that allows a portion of the cleaning substrate to be removed from the continuous web of substrate 85. The regular interval between the lines of weakness 87 would be an interval that would balance the needs of various widths of working heads. For example, the system of the present invention may include floor mops having head widths of 12 inches (305 mm), 18 inches (457 mm), 24 inches (610 mm), 36 inches (914 mm), and 48 inches (1.2 m). In such a system, a selectable-size substrate 85 would preferably have lines of weakness 87 at 6-inch (152 mm) intervals. The user would then be able to easily tear off any appropriate length of substrate 85 for the particular width head that they were using.

Figure 12:
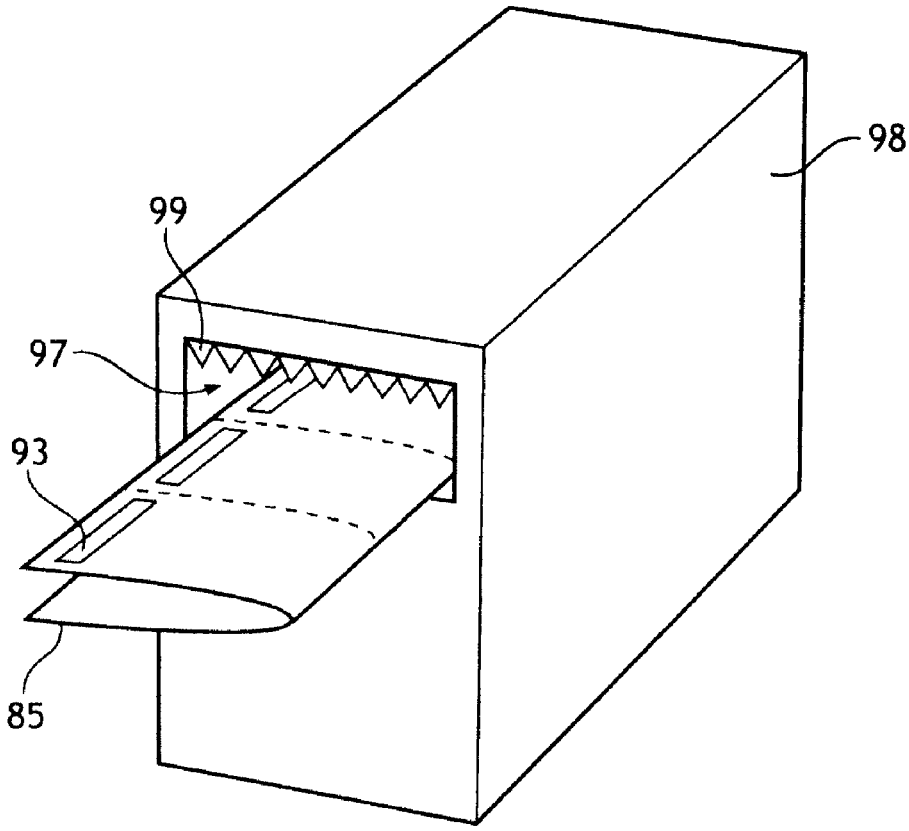
FIG. 12 is a perspective view of a continuous web of selectable-width cleaning substrate and disposed within a container.

Such disposable cleaning substrates may be a single flat sheet as shown in FIG. 11, a folded or two-ply sheet as shown in FIG. 12, a tubular substrate, or other formats that could be provided as a continuous web and as necessary for the various working heads of the system. As shown in FIG. 12, such substrates may additionally include substrate fasteners 93 that may interact with the particular working heads to attach the substrate to those working heads.

The selectable-size substrate shown in FIG. 11 is provided in a roll format 89. As such, the roll 89 could be mounted in a roll product dispenser, as are commonly available and widely understood. Such a dispenser could be available on the wall, on a cart, or wherever would be most convenient for the user of the system. Alternatively, the selectable-size substrate 85 may be provided to the user in a container 98, such as shown in FIG. 12. The substrate 85 could be stored and dispensed from the container 98 through a dispensing opening 97 in the container 98. The substrate 85 may be available in the container 98 in any format that is desired. It may be a roll 89, as in FIG. 11, merely piled in the container 98, or may be festooned within the container 98.

Additional functionality could also be added to the container 98. As shown in FIG. 12, the container 98 may have a separator 99 that the user could use to more easily separate the cleaning substrate along the lines of weakness 87. Such containers 98 may also include indicia that would help the user identify the amount or type of substrate contained, instructions on proper use, disposal instructions, or other messages that are desired to be conveyed to the user. Such indicia may be any word(s), numeral(s), line(s), symbol(s), picture(s), color(s) and/or combination(s) thereof, that convey the desired message. Additionally, or alternatively, the container 98 may have additional features such as viewing slots such the user can see the amount of remaining substrate, mounting brackets for mounting the container 98 on a support surface, disposal/recycling features, or other such characteristics that enhance the system and make it easier to use.

It will be appreciated that the foregoing examples and discussion, given for purposes of illustration, are not to be construed as limiting the scope of this invention, which is defined by the following claims and all equivalents thereto.

We claim:

1. A quick-release handle adapted for use with a working head having a socket mount configured to receive said quick-release handle, the handle comprising:

a hollow elongated shaft comprising an outer peripheral surface, a proximal end proximate to the socket mount, a distal end distal to the socket mount, the distal end comprising a distal end surface;

a quick-release coupling assembly positioned on the proximal end of the shaft to releaseably couple the handle with the socket mount;

a button actuator on the distal end of the shaft, the button actuator operably connected to the quick-release coupling assembly, wherein the button actuator is configured to move along the axis of the shaft between a neutral configuration and a depressed configuration, and wherein the button actuator is biased to the neutral configuration; and an ergonomic, freely-rotating knob positioned on the distal end of the shaft to rotate about the axis of the shaft, wherein the button actuator passes through the knob and further wherein the rotary movement of the knob and the axial movement of the button actuator are independent of each other, wherein the handle is positioned in an engaged configuration when the button actuator is in the neutral configuration such that the coupling assembly is releaseably coupled with the socket mount, and wherein the handle is positioned in a release configuration when the button actuator is in the depressed configuration such that the coupling assembly disengages from the coupled socket mount.

2. The handle of claim 1, further comprising a push rod positioned inside the hollow elongated shaft, the push rod extending between the button actuator and the quick release coupling assembly, and wherein the push rod comprises a first end proximate to the proximal end of the shaft and a second end proximate to the distal end of the shaft.

3. The handle of claim 2, wherein the quick-release coupling assembly further comprises:

a stepped tip comprising an internal longitudinal channel;

at least one detent ball movable in and out of a port on the stepped tip;

a stop rod positioned at the first end of the push rod, the stop rod operably connected to the push rod, and wherein the stop rod is inserted into said internal longitudinal channel, wherein the stop rod is configured to push the detent ball out of the port into engagement with the socket mount when the handle is in the engaged configuration, and wherein the stop rod is configured to permit the detent ball to disengage from the socket mount when the handle is in the release configuration.

4. The handle of claim 1, wherein the button actuator is configured to be recessed within the distal end surface.

5. The handle of claim 1, further comprising a coupler shroud positioned at the proximal end of the shaft.

6. The handle of claim 1, wherein the knob is positioned on the terminus of the distal end of the shaft, wherein the button actuator is configured to be recessed within the distal end surface, and wherein the knob freely rotates about the recessed button actuator.

7. A mop assembly comprising:

a mop head comprising a socket mount; and the quick-release handle of claim 1.

8. The mop assembly of claim 7, wherein the socket mount further comprises a retention stop inside the socket mount, the retention stop configured to engage the quick-release coupling assembly.

9. The mop assembly of claim 8, wherein the retention stop comprises a ring inside the socket mount.

10. The mop assembly of claim 8, wherein the socket mount comprises threads.

11. The mop assembly of claim 7, wherein the mop head further comprises a head coupler that couples the mop head with the socket mount, the head coupler configured to permit the handle to move up and down and from side to side relative to the mop head when the handle is releaseably attached to the socket mount.

12. The mop assembly of claim 7, wherein the quick-release handle further comprises a coupler shroud positioned at the proximal end of the shaft, the coupler shroud configured to cooperatively engage the socket mount.

13. The mop assembly of claim 7, wherein the knob is positioned on the terminus of the distal end of the shaft and the button actuator is configured to be recessed within the distal end surface, and wherein the knob freely rotates about the recessed button actuator.

14. A cleaning system comprising:

the quick-release handle of claim 1, further comprising a grip end and an attachment end opposite to the grip end; and a plurality of working heads, each working head comprising a socket mount configured to cooperate with the quick release handle, wherein the handle comprises a coupler shroud positioned on the attachment end of the handle.

15. The cleaning system of claim 14, wherein the plurality of working heads comprises a plurality of mop heads of various widths.

16. The cleaning system of claim 15, further comprising a continuous web of cleaning substrate to be used with the plurality of mop heads, the continuous web comprising lines of weakness at regular intervals such that various widths of cleaning substrate are removable via the lines of weakness.

17. The cleaning system of claim 16, further comprising a container comprising a dispensing opening, wherein the container contains the continuous web of substrate and dispenses the substrate through the dispensing opening.

18. The cleaning system of claim 17, further comprising a separator associated with the container, the separator configured to assist separating the cleaning substrate from the continuous web of cleaning substrate.

19. The cleaning system of claim 14, wherein the plurality of working heads comprises two or more types of working head selected from the group consisting of dry mop head, wet mop head, broom, paint roller, light bulb changer, and squeegee.

20. The cleaning system of claim 14, wherein each of the working heads further comprises a head coupler that couples the working heads with the socket mount, the head coupler configured to permit the handle to move up and down and from side to side relative to the working head.

* * * * *